United States Patent [19]

Wang

[11] Patent Number: 4,736,847

[45] Date of Patent: Apr. 12, 1988

[54] PLAY BIN

[76] Inventor: Ted T. H. Wang, Room 401, 168, Chung Cheng 4 Rd., Kaohsiung, Taiwan

[21] Appl. No.: 947,721

[22] Filed: Dec. 30, 1986

[51] Int. Cl.[4] ..... B65D 90/20; B65D 90/02

[52] U.S. Cl. ..... 206/457; D6/435; 150/52 R

[58] Field of Search ..... D6/435; 206/457; 150/52 R

[56] References Cited

U.S. PATENT DOCUMENTS

| | | | |
|---|---|---|---|
| 1,756,048 | 4/1930 | Williams | 206/457 X |
| 3,867,971 | 2/1975 | Hazah | 206/457 X |
| 4,200,197 | 4/1980 | Meyer et al. | 220/263 |

FOREIGN PATENT DOCUMENTS

| | | | |
|---|---|---|---|
| 1205899 | 11/1965 | Fed. Rep. of Germany | 150/52 R |
| 2041332 | 9/1980 | United Kingdom | 150/52 R |

*Primary Examiner*—William Price

*Attorney, Agent, or Firm*—Varndell Legal Group

[57] ABSTRACT

A play bin made up of three main parts; a frame, made to simulate the body part of an animal, and constructed with plastic tubes connected together with various kinds of joints, which can sit on the ground; a cover, also made to simulate the body part of the animal, made of a kind of leather, having a lid and two zippers for placing toys or clothes into or removing the same from the play bin; a head with a neck that can be inserted in an opening at the top of the cover, which can be made together with the cover as one unit or separately therefrom. The frame is placed inside the cover in a manner so that it exerts a little expanding elasticity and thus pushes the cover outwardly, keeping a tightly fit combination.

4 Claims, 4 Drawing Sheets

PLAY BIN

BACKGROUND OF THE INVENTION

It cannot be denied that children are very fond of toys. Nowadays, they are fortunate to have accessible to them many kinds of toys. Many families have a children's room where they can sleep and play. However, when playing children often scatter their toys around, which embarrasses their parents. In order to pick up, collect, and store toys, parents may make use of large boxes, cartons, or plastic baskets, etc. However, such containers do not necessarily correspond with the decorum or atmosphere of the children's room.

The present inventor has invented a play bin which has an animal shape that is appealing to children. The present invention provides a play bin for children to store their toys or other things, which decorates their rooms to some extent, so that they can grow up and educate themselves in a clean and orderly environment.

SUMMARY OF THE INVENTION

This invention is directed to a play bin which is to be used for storing toys, as well as for decorating a room where it is placed. It includes a frame shaped like an animal, such as a kangaroo, a hippo, a dog, a frog, etc. The frame is constructed with joints and tubes. A cover shaped like the same animal as the frame and made of soft leather is placed around the frame. A decorated animal head made of, for example, plastic foam is assembled together with the cover and frame to complete the present invention.

DETAILED DESCRIPTION OF THE INVENTION

Figure 5:
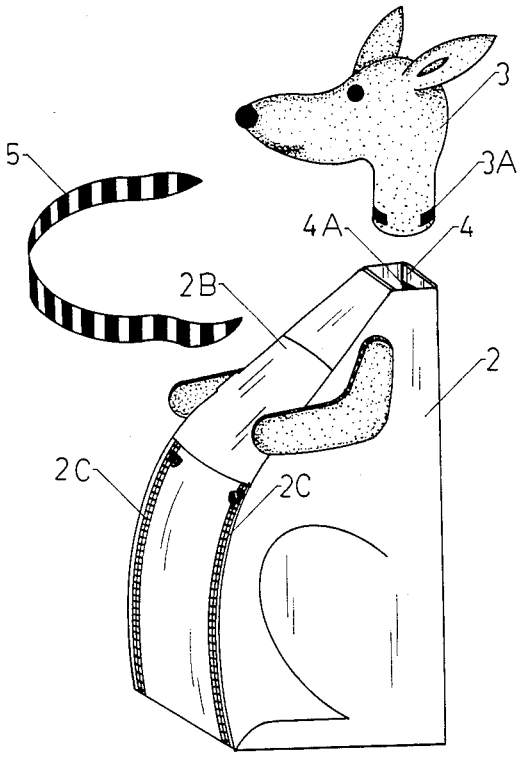
FIG. 5 is a view of the head separated from the body in the one example of the present invention.
Figure 6:
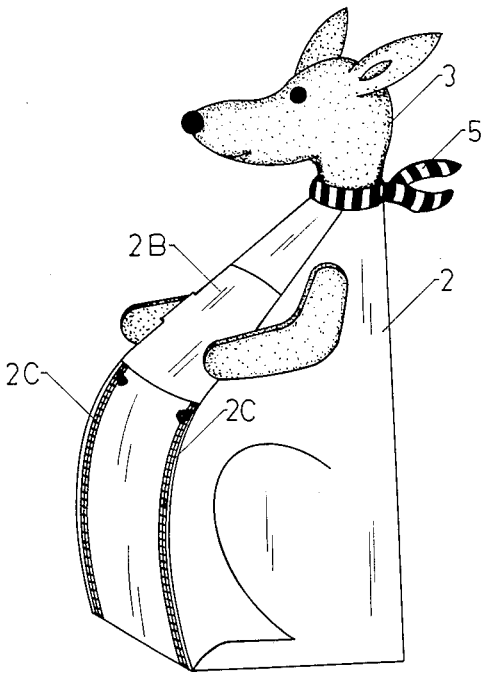
FIG. 6 is a whole view of the one example of the present invention.

One example of this invention is shaped like a kangaroo and consists of frame 1, cover 2, and head 3 as shown in FIG. 5, but this outward shape can be changed to other animals, such as a hippo, a dog, a frog, an elephant, etc.

First, frame 1 is made to represent the body part of a kangaroo, assembled with tubes and joints; next, cover 2, made of soft leather to simulate the kangaroo body, is placed on around frame 1. A simulated kangaroo head 3, made of a plastic foam or other material, is placed in opening 4 of cover 2; and then muffler 5 is placed around the neck part, the lower part of head 3, hiding the line where head 3 and its body, i.e., cover 2 and frame 1, are combined together.

FIG. 5 shows that cover 2 has been put around frame 1, but head 3 has not yet been assembled thereto. Head 3 has a round neck at its lower part, which has two fastening bands 3A symmetrically located for fastening together with fastening bands 4A inside opening 4 when head 3 is placed in opening 4. Since opening 4 is not originally round, it should be pushed by hand to conform with the round neck when assembled. Also, a muffler is placed around the neck to hide the line where the neck and opening 4 are combined together. This completes the assembly of the play bin.

Cover 2 is placed around frame 1 and envelopes it. The uppermost four frame tubes of frame 1 are inserted into a flat long bag 2A, extending downward from openings 4 inside cover 2. Two hands and two feet are placed at both sides of cover 2, and there is lid 2B at the middle front of cover 2 for removing toys from under or inserting toys underneath cover 2. Cover 2 also has a swelled part like the animal's abdomen for holding toys placed therein. At both sides of the abdomen (the swelled part), there are symmetrically fixed two zippers for closing or opening the abdomen, if necessary.

Figure 1:
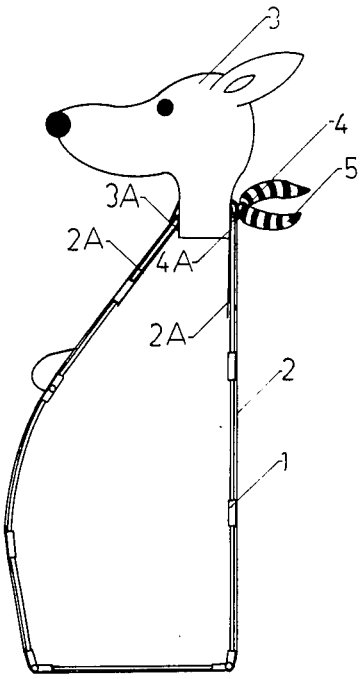
FIG. 1 is a constructional diagram of one example of the present invention.
Figure 2:
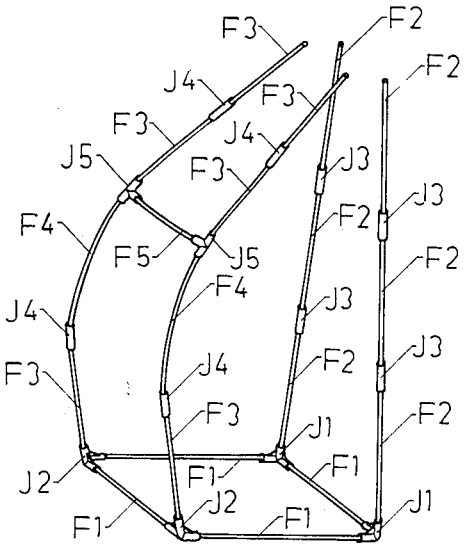
FIG. 2 is a constructional view of the frame enveloped by the cover of the example shown in FIG. 1.
Figure 3:
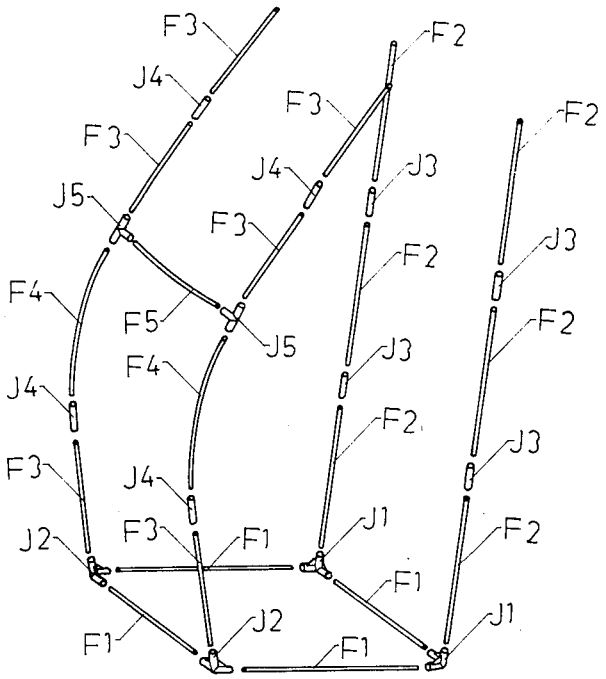
FIG. 3 is an explosive perspective view of FIG. 2.
Figure 4:
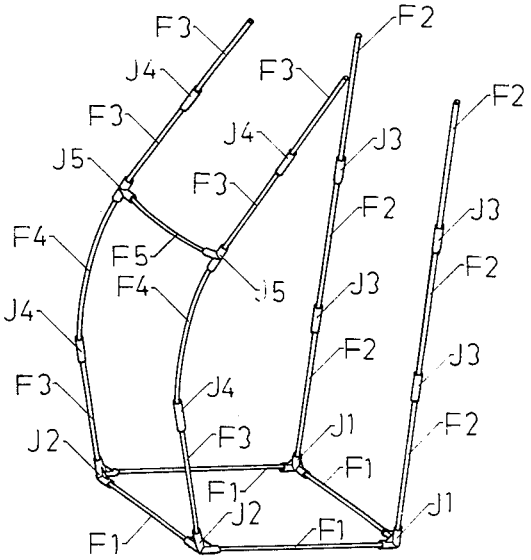
FIG. 4 is a view of the frame not enveloped by the cover of the one example of the present invention.

As shown in FIGS. 3 and 4, frame 1 of this one example of the play bin of the present invention has two trident joints J1 at the rear and two trident joints J2 at the front connecting horizontally four frame tubes F1 for sitting on the ground. Frame 1 also has three frame tubes F2 connected perpendicularly with two straight joints J3 and then with two trident joints J1 at the rear. In addition, frame 1 has thre frame tubes F3 and one bending frame tube F4 connected perpendicuarly with two straight joints J4 and one tee joint J5. There is also one bending frame tube F5 connected between said two tee joints J5 for maintaining the swelled part, i.e., the abdomen of the animal.

Said frame tubes F1, F2, F3, F4, and F5 are made of plastic tubes with a little flexibility. When frame 1 is placed inside cover 2, the vertical frame tubes, F2, F3, and F4, should be bent a little inward to push cover 2 outwardly, i.e. elastically. The four uppermost tubes F2 and F3 are inserted in flat long bag 2A while it is kept in place, resulting in that the combination of frame 1 and cover 2 is quite tight and that the frame tube and the joints may not be easily loosened from one another. Therefore, this one example of the play bin of the present invention can keep its simulated animal shape, set steadily on the ground, furnish storage space, and arouse a child's curiosity.

What is claimed is:

1. A play bin for storing toys consisting of a frame including means for constructing said frame to simulate an animal body and for constructing said frame to set flat on a surface, said means including long, short, straight or bent tubes connected together with various joints including straight or tee joints, a cover constructed to simulate said animal body for enveloping around said frame, said cover including a lid and two zippers fitted thereon for placing toys or clothes into or for removing toys or clothes from a portion of said animal body, said frame and said cover being constructed so that said frame pushes said body outwardly for maintaining a tightly fit combination, and an animal head and means for connecting said animal head to said animal body.

2. A play bin as claimed in claim 1, wherein said frame is originally made larger than said cover so that after said frame has been placed inside said cover, said frame is reduced in size by its elasticity and pushes said cover outwardly for maintaining said frame and said cover in a sufficiently tight combination.

3. A play bin for storing toys consisting of a frame including means for constructing said frame to simulate an animal body and for constructing said frame to set flat on a surface, said means including long, short, straight or bent tubes connected together with various joints including straight or tee joints, a cover constructed to simulate said animal body for enveloping around said frame, said cover including a lid and two zippers fitted thereon for placing toys or clothes into or for removing toys or clothes from a portion of said animal, and an animal head affixed to said cover, and said frame and said cover being constructed so that said frame pushes said body outwardly for maintaining a tightly for fit combination.

4. A play bin as claimed in claim 3, wherein said frame is originally made larger than said cover so that after said frame has been placed inside said cover, said frame is reduced in size by its elasticity and pushes said cover outwardly for maintaining said frame and said cover in a sufficiently tight combination.

* * * * *